US011280007B2

(12) United States Patent
Saget

(10) Patent No.: US 11,280,007 B2
(45) Date of Patent: Mar. 22, 2022

(54) CHEMICAL PROCESS FOR MATIFICATION

(71) Applicant: SAFRAN AIRCRAFT ENGINES, Paris (FR)

(72) Inventor: Pierre-Joseph Xavier Hervé Saget, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/664,461

(22) Filed: Oct. 25, 2019

(65) Prior Publication Data

US 2020/0131646 A1 Apr. 30, 2020

(30) Foreign Application Priority Data

Oct. 26, 2018 (FR) ..... 1859935

(51) Int. Cl.
*C23F 1/16* (2006.01)
*C23F 1/26* (2006.01)
*C23G 1/14* (2006.01)

(52) U.S. Cl.
CPC . *C23F 1/26* (2013.01); *C23G 1/14* (2013.01)

(58) Field of Classification Search
CPC ..... C23F 1/16
See application file for complete search history.

(56) References Cited

U.S. PATENT DOCUMENTS 4,551,434 A 11/1985 Thoma
5,098,540 A * 3/1992 McKee ..... C23C 14/16 204/192.15
5,158,623 A * 10/1992 Michaud ..... B24B 31/14 148/269
2004/0044271 A1* 3/2004 Stone ..... A61B 1/0638 600/182
2005/0011863 A1* 1/2005 Wayte ..... G01N 33/208 216/83
2008/0245845 A1* 10/2008 Kool ..... B23K 35/3605 228/119
2018/0094918 A1* 4/2018 Morimoto ..... G01B 11/165

FOREIGN PATENT DOCUMENTS

EP 1 498 731 A2 1/2005
EP 1 498 731 A3 1/2005
EP 1 947 217 A1 7/2008

OTHER PUBLICATIONS

"Sulfuric Acid Storage Tank & Specifications", ProTank, Web site, no date.*
French Search Report and Written Opinion dated Jul. 31, 2019, issued in corresponding French Application No. 1859935, filed Oct. 26, 2018, 6 pages.

* cited by examiner

*Primary Examiner* — Thomas T Pham
(74) *Attorney, Agent, or Firm* — Christensen O'Connor Johnson & Kindness PLLC

(57) ABSTRACT

The invention relates to a method for mattifying a turbine engine part (10) comprising a metal material, the method comprising a step of immersing said part in a chemical bath (14) for mattifying said metal part (10), the bath (14) comprising at least sodium fluoride (NaF) and hydrofluoric (HF) acid, characterised in that the immersion step lasts between 2 and 15 minutes.

20 Claims, 1 Drawing Sheet

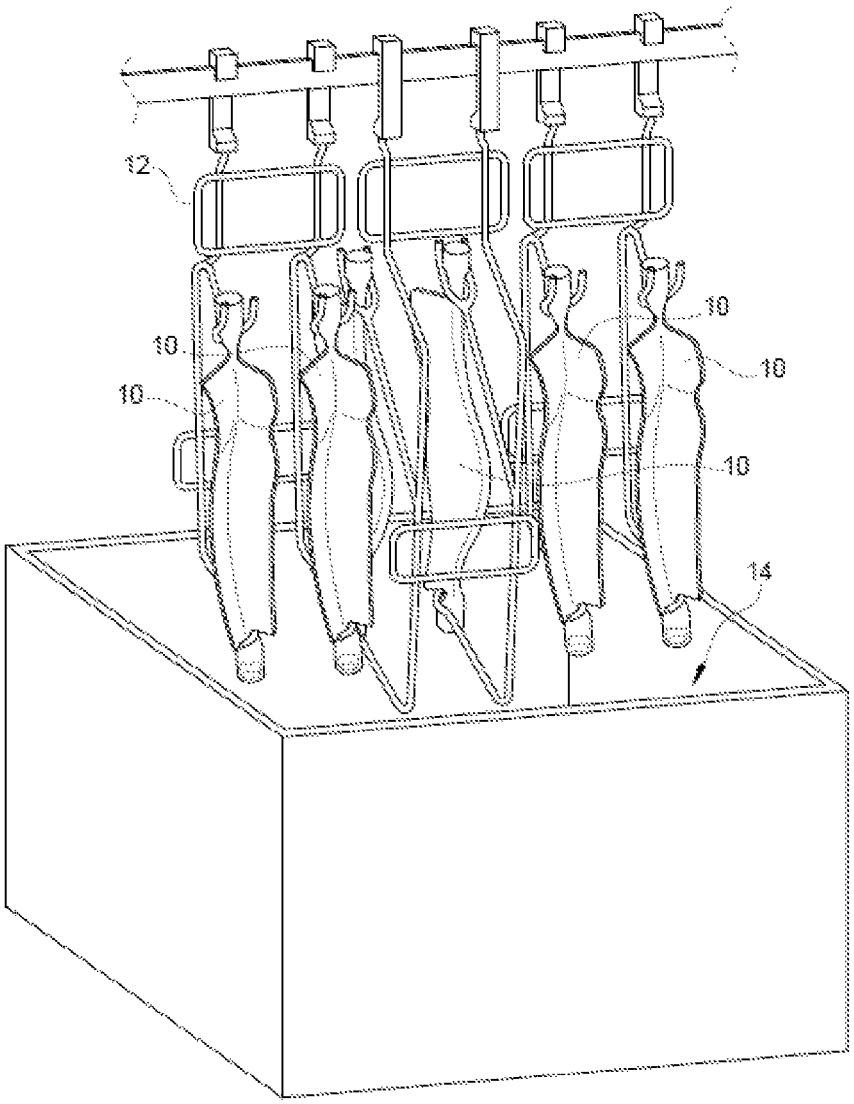
12
10
10
10
10
10
14

CHEMICAL PROCESS FOR MATIFICATION

FIELD OF THE INVENTION

The present invention relates to the general field of mapping measurements of turbine engine parts, in particular so-called CM contactless measuring methods, in particular preparing upstream parts of these measurements.

STATE OF THE ART

In the context of the program of producing turbine engines, in particular aircraft turbine engines, certain parts entering into the composition of said turbine engines are mapped by means of a contactless measuring, called "CM". This measuring is, for example, a so-called "optical" measuring, as for example illustrated in document FR 2 961 598 A1. According to the methods, the measurements can occur at different production stages, in certain cases whilst the parts are not finished. Yet, the unfinished parts can thus be too shiny, and the machine intended to implement the CM method cannot acquire the data necessary for the mapping, in particular due to various reverberations and/or reflections. In order to be able to conduct these mappings at the stage of producing the desired turbine engine, the parts are mattified by operators.

Conventionally, and in a manner known per se, this mattifying is done by hand in a tumbling sludge.

The tumbling (also called mechanical-chemical polishing, tribofinishing or Trowalising) is a well-known method which makes it possible to modify the surface state and the edges of a part, in particular made of metal. The part is immersed in an abrasive mixture moved by vibration, oscillation and/or rotation in a tank. The result observed on the part is due to the friction between the part and the abrasive mixture. This result depends on the type of equipment used, on the composition of the abrasive mixture, on the speed parameters and on the duration of the operation.

In the present case, the mattifying of the turbine engine parts to be mapped is done by means of this tumbling sludge. This sludge is recovered then deposited by brush on the part to be mapped before measuring, then removed after the CM measurement using a cloth and possibly rinsing.

This method can impact the precision of the measurement, due to a non-homogenous mattified aspect of the mapped part and of the potential presence of residue. In addition, it requires numerous repetitive and difficult handlings and thus poses ergonomic, safety, health and environmental (SHE) problems, such as musculoskeletal trauma. Through these handlings, this method causes a loss of time and is expensive.

AIM OF THE INVENTION

The aim of the present invention is to treat parts to be mapped so as to obtain a homogenous mattifying, without potential residue, which is safer and cheaper than the methods of the state of the art, and which can furthermore be achieved industrially.

SUMMARY OF THE INVENTION

This aim according to the invention is achieved thanks to a method for mattifying a turbine engine part comprising a metal material, the method comprising a step of immersing said part in a bath for chemically mattifying said metal part, the bath comprising at least sodium fluoride (NaF) and hydrofluoric (HF) acid, characterised in that the immersion step lasts between 2 and 15 minutes.

Thus, this chemical mattifying solution makes it possible to achieve the abovementioned aim. The mattifying is indeed obtained homogenously by immersion or soaking in a bath and with the number of handlings being reduced, safety and reliability are increased.

The method also comprises one or more of the following features, taken individually or in combination:

- the immersion step is configured so as to create a homogenous dissolution of the metal material over a thickness of around 3 to 10 μm, and in that the part is enriched with a minimum quantity of dihydrogen ($H_2$),
- the metal material of the part comprises titanium (Ti), a titanium alloy and/or titanium oxides ($TiO_2$),
- the dissolved material thickness is 5 μm,
- the enriching in dihydrogen ($H_2$) of the part is around 15 ppm,
- the part is obtained by a forging process and has, on the surface, a titanium oxide ($TiO_2$) and alpha case layer, the homogenous dissolution making it possible to remove the titanium oxide ($TiO_2$) and alpha case layer,
- the homogenous dissolution occurs successively and/or at the same time according to two of the following chemical reactions:

$$NaF+H_2SO_4 = FH+NaHSO_4 \quad (1)$$

$$TiO_2+6HF \rightarrow TiF_6H_2+H_2O \quad (2)$$

- the method comprises a step of installing at least one part to be mattified in a tool prior to the step of immersing in the chemical bath,
- the temperature of the chemical bath during the immersion step is between 15 and 30° C.,
- the method comprises the following steps:
- a step of preparing the surface of the at least one part, and
- a step of rinsing the part,
- the step of preparing the surface of the part is carried out before the immersion step and comprises:
- a step of degreasing the part for 10 minutes at a temperature of between 45 and 55° C., during which the tool is immersed in an alkaline bath,
- a first step of passive rinsing of 60 seconds at ambient temperature, during which the tool is immersed in a water bath,
- a first step of current rinsing of 120 seconds at ambient temperature, during which the tool is immersed in a running water bath or water-sprayed,
- a step of rinsing then drying the parts coming from this same tool.

BRIEF DESCRIPTION OF THE FIGURES

The invention will be best understood, and other aims, details, features and advantages of it will appear more clearly upon reading the following detailed, explanatory description, of embodiments of the invention given as purely illustrative and non-limiting examples, in reference to the appended schematic drawing, wherein FIG. 1 represents a series of turbine engine parts to be mapped, aligned on a tool, ready to be immersed in a bath according to the invention, according to the mattifying method according to the invention.

DESCRIPTION OF EMBODIMENTS OF THE INVENTION

The operating conditions of turbine engines, lead to using numerous metal parts 10. In particular, some of these metal parts 10 are made of titanium (Ti) or of alloys comprising titanium (Ti). It is important, that during the production of the turbine engine, that these parts 10 undergo a non-destructive test intended to highlight possible production defects. These parts 10 are conventionally obtained by forging methods and are, following the fitting thereof, very shiny.

These parts 10 have, furthermore, an oxide (TiO2) and alpha case layer at the surfaces thereof. This layer conventionally comes from any method for forging parts 10 comprising titanium (Ti). In metallurgy, the term "alpha case" means an oxygen-enriched surface phase appearing when titanium (Ti) or the alloys thereof are exposed to air or highly heated oxygen. This phase is hard and brittle, tends to have microcracks and weakens the properties of the metal part.

The present invention therefore has the advantage of mattifying the parts 10 to be mapped, while clearing them of the different oxides and surface alpha cases.

In FIG. 1, a series of parts 10 to be mattified in view of being mapped can therefore be seen. In the present case, these are leading edges intended to equip turbine engine members such as compressor vanes. These parts 10, are fixed and aligned on a tool 12 intended to be immersed, with the parts 10, in a succession of different baths.

During the installation or implementation of parts 10 on the tool 12, it must be verified that the parts 10 do not touch one another, as this could prevent the action of the different baths over the whole of the surface of each of the parts 10. To this end, the tool can carry up to six parts to leave a sufficient space between each part. Of course, the number of parts will depend on the size of the tool and on the size of the containers or tanks intended to contain the baths. It must also be verified that the tool 12 is in operation and that it is clean. Moreover, the etching of the number of the tool 12 must be legible, with the aim of ensuring the good traceability of the part.

The tool also comprises a dissolution tube (not represented), making it possible to determine the mattifying time. The tube used is conventionally a metal tube. This metal tube is made of a titanium (Ti) alloy of type TA6V and here, has a rectangular shape.

Once the parts 10 have been correctly fixed on the tool 12, and that is in a good operating condition, the tool 12 is immersed in a first tank comprising an alkaline bath, for example a soda-based bath. This makes it possible to achieve degreasing of the parts 10. This step of degreasing the parts 10 lasts 10 minutes (with a tolerance of ±5 minutes). The temperature of the alkaline bath is between 45 and 55° C.

The tool 12 with the parts 10 is then immersed in a second tank, this second tank comprising water. This makes it possible to carry out a first step of rinsing, termed passive rinsing, the degreased parts 10.

Conventionally and in a manner well known per se, the passive rinsing, also called static rinsing, means a pre-rinsing which is used to retain a portion of the pollution coming from a treatment bath, here the alkaline bath. The passive rinsing bath is not continuously supplied with fresh water, but periodically renewed. If this bath aims to treat special waste, this can be a manner to reduce the rejected pollution load. The passive rinsing also makes it possible to decrease the rinsing water quantity. For example, a passive rinsing drained when it has reached 20% of the concentration of the treatment bath makes it possible to divide the rinsing water quantity by 5, that is an 80% saving of water.

This first passive rinsing step lasts around 60 seconds. This step is carried out, advantageously at ambient temperature.

The tool 12 with the parts 10 is then immersed in a third tank also comprising, also water. This makes it possible to carry out a first rinsing step called current rinsing step, i.e. that the third tank is constantly supplied with fresh/running water. This first current rinsing lasts around 120 seconds. This current rinsing is done, advantageously at ambient temperature. This step can also be carried out by spraying the tool 12.

The tool 12 and the parts 10 are thus immersed in a fourth tank. This fourth tank also comprises the chemical bath 14 according to the invention. It is in this fourth tank that the step of treating the metal parts is carried out. This treatment step is, strictly speaking, the chemical mattifying step. To carry out this mattifying, the parts are immersed in the chemical bath so as to obtain a homogenous dissolution of the metal material. The immersion of the parts lasts between 2 and 15 minutes (with a tolerance of ±1 minute). This immersion step is carried out at a temperature of between 15 and 30° C. In particular, the chemical bath is brought to this temperature of between 15 and 30° C.

The bath 14 of the immersion or treatment step comprises, in particular, sodium fluoride (NaF) at a rate of 11 to 15 g per litre of bath 14 and of sulphuric acid ($H_2SO_4$) (of density 1.83) at a rate of 75±5 mL per litre of bath 14. The rest of bath 14 is completed with water ($H_2O$). The sodium fluoride (NaF) in the aqueous solution releases $F^-$ ions and the sulphuric acid ($H_2SO_4$) gives $H^+$ ions, making it possible to form diluted hydrofluoric (HF) acid. Thus, the sodium fluoride (NaF) and the sulphuric acid ($H_2SO_4$) react with one another according to the equation:

$$NaF+H_2SO_4 = FH+NaHSO_4,$$

and hydrofluoric (HF) acid is thus obtained.

When the parts 10 having titanium oxides ($TiO_2$) on the surface are immersed in the chemical bath 14, a reaction of the hydrofluoric (HF) acid with the titanium oxides ($TiO_2$) is observed, according to the equation:

$$TiO_{2(s)}+6HF_{(l)} \rightarrow TiF_6H_{2(s)}+H_2O_{(l)}.$$

With $Ti^{4+}$ ions not existing in solution, they are complexed by $F^-$ ions to give, in particular, the solid entity $TiF_6H_2$ which is dissolved in the bath 14. The surface of the parts 10 is cleared of the oxides and the surface of each part 10 is thus cleaned/mattified homogenously.

Through the complexing power thereof, the $F^-$ ion makes titanium (Ti) pass in $Ti^{3+}$ form and a hydrogen $H_2$ gas emission is observed. This hydrogen emission enriches the surfaces of the parts 10 mattified with $H^+$ ions by adsorption on the surface then by penetration. In the case of the present invention, a weak dissolution of the titanium (Ti) is created, without highly enriching the part 10 with $H^+$. The enriching with $H_2$ is limited to around 15 ppm±5 ppm.

The thickness of the dissolved layer is between 3 and 10 μm. This dissolved layer thickness is not, preferably, greater than 5 μm.

The time for treating the parts 10 is developed on each series of parts 10 according to the shine thereof following fitting, in order to make them sufficient matt, without consuming more than 5 μm of dissolution thickness. More specifically, the immersion step is configured to as to create a homogenous dissolution of the metal material of the part 10 over a thickness of around 3 to 10 μm. This configuration also ensures that the part 10 is enriched with a minimum quantity of dihydrogen ($H_2$).

After the treatment step, the tool 12 is immersed in a fifth tank. This tank contains water and makes it possible to carry out a second passive rinsing step of around 60 seconds, this step taking place at ambient temperature.

The tool 12 is thus immersed in a sixth tank containing water moved in order to carry out a second current rinsing step of around 120 seconds at ambient temperature. Like the preceding current rinsing step, this step can be carried out by water-spraying means.

Finally, the tool 12 and the parts 10 are immersed in a seventh tank containing water at a temperature greater than or equal to 70° C. and forming a hot rinsing bath. This hot rinsing lasts 45 seconds.

Following this last rinsing, the parts 10 are disconnected from the tool 14 and are tested by a suitable CM.

This solution furthermore makes it possible for good measuring precision, as the mattified appearance is homogenous and the part is perfectly clean (no residue) for the measurement.

This solution is of course applicable to any part type, which could equip any type of turbine engine.

Replacing the use of tumbling sludge with a chemical bath according to the invention, so as to mattify the part, has a significant economic interest: less accidents and a highly reduced analysis time. Indeed, this analysis time goes from around 3 hours for six parts, to around 30 minutes for six parts.

The embodiments of the invention in which an exclusive property or privilege is claimed are defined as follows:

1. A method of mapping a turbine engine part comprising a metal material, the method comprising the following steps:

a step of preparing a surface of the at least one part comprising:

a step of degreasing the part for 10 minutes at a temperature of between 45 and 55° C., during which the tool is immersed in an alkaline bath;

a first step of passive rinsing of 60 seconds at ambient temperature, during which the tool is immersed in a water bath; and a second step of current rinsing of 120 seconds at ambient temperature, during which the tool is immersed in a running water bath or water-sprayed;

following the step of preparing the surface, mattifying the part by immersing said part in a chemical bath for mattifying said metal material, the chemical bath comprising at least sodium fluoride (NaF) and hydrofluoric (HF) acid, that wherein the immersion step lasts between 2 and 15 minutes; and measuring by a contactless method a parameter of the part to establish a mapping.

2. The method according to claim 1, wherein the immersion step provides a homogenous dissolution of the metal material over a thickness of around 3 to 10 μm.

3. The method according to claim 1, wherein the metal material of the part comprises titanium (Ti), a titanium alloy and/or titanium oxides ($TiO_2$).

4. The method according to claim 1, wherein the immersion step leads to a dissolution of the metal material of the part over a thickness of 5 μm.

5. The method according to claim 1, wherein the part is enriched with dihydrogen ($H_2$) and in that the enriching with dihydrogen ($H_2$) of the part is around 15 ppm.

6. The method according to claim 2, wherein the part has, on the surface, a titanium oxide ($TiO_2$) and alpha case layer, the homogenous dissolution making it possible to remove the titanium oxide ($TiO_2$) and alpha case layer.

7. The method according to claim 1, it comprises further comprising a step of installing at least one part to be mattified in a tool prior to the step of immersing in the chemical bath.

8. The method according to claim 7, wherein the temperature of the chemical bath during the immersion step is of between 15 and 30° C.

9. The method according to claim 1, wherein the concentration of sodium fluoride (NaF) is from 11 g to 15 g per litre of bath and wherein the bath further comprises sulphuric acid ($H_2SO_4$) at a concentration of 75+/−5 mL per litre of bath, the remaining being completed with water ($H_2O$).

10. A method of mapping a turbine engine part comprising a metal material, the method comprising the following steps:

a step of preparing the surface of the at least one part comprising:

a step of degreasing the part for 10 minutes at a temperature of between 45 and 55° C., during which the tool is immersed in an alkaline bath;

a first step of passive rinsing of 60 seconds at ambient temperature, during which the tool is immersed in a water bath; and a second step of current rinsing of 120 seconds at ambient temperature, during which the tool is immersed in a running water bath or water-sprayed;

following the step of preparing the surface, mattifying the part by immersing said part in a chemical bath for mattifying said metal material, the chemical bath comprising at least sodium fluoride (NaF) and hydrofluoric (HF) acid, the immersion step lasting between 2 and 15 minutes, and the chemical bath further comprising sulphuric acid ($H_2SO_4$) and water ($H_2O$), wherein the homogenous dissolution occurs successively and/or at the same time according to two of the following chemical reactions:

$$NaF+H_2SO_4 = FH+NaHSO_4 \quad (1)$$

$$TiO_2+6HF \rightarrow TiF_6H_2+H_2O; \text{ and} \quad (2)$$

measuring by a contactless method a parameter of the part to establish a mapping.

11. A method of mapping a turbine engine part comprising a metal material, the method comprising:

installing said part in a tool;

immersing said part in a chemical bath for mattifying said metal material, the chemical bath comprising sodium fluoride (NaF) and hydrofluoric (HF) acid, wherein the immersion step lasts between 2 and 15 minutes;

rinsing the part, carried out after the immersing, and comprising:

a passive rinsing step of 60 seconds at ambient temperature, during which the tool is immersed in a water bath;

a current rinsing step of 120 seconds at ambient temperature, during which the tool is immersed in a running water bath or water-sprayed; and a final hot rinsing step of 45 seconds at a temperature greater than or equal to 70° C., during which the tool is immersed in a running water bath or water-sprayed; and measuring by a contactless method a parameter of the part to establish a mapping.

12. The method according to claim 11, wherein the metal material of the part comprises titanium (Ti), a titanium alloy and/or titanium oxides ($TiO_2$).

13. The method according to claim 11, wherein the immersion step leads to a dissolution of the metal material of the part over a thickness of 5 μm.

14. The method according to claim 11, wherein the part is enriched with dihydrogen ($H_2$) and in that the enriching with dihydrogen ($H_2$) of the part is around 15 ppm.

15. The method according to claim 11, wherein the immersion step provides a homogenous dissolution of the metal material over a thickness of around 3 to 10 μm.

16. The method according to claim 15, wherein the part has, on the surface, a titanium oxide ($TiO_2$) and alpha case layer, the homogenous dissolution making it possible to remove the titanium oxide ($TiO_2$) and alpha case layer.

17. The method according to claim 16, wherein the chemical bath further comprises sulphuric acid ($H_2SO_4$) and water ($H_2O$) and wherein the homogenous dissolution occurs successively and/or at the same time according to two of the following chemical reactions:

$$NaF+H_2SO_4 = FH+NaHSO_4 \quad (1)$$

$$TiO_2+6HF \rightarrow TiF_6H_2+H_2O \quad (2)$$

18. The method according to claim 11, further comprising a step of installing at least one part to be mattified in a tool prior to the step of immersing in the chemical bath.

19. The method according to claim 18, wherein the temperature of the chemical bath during the immersion step is of between 15 and 30° C.

20. The method according to claim 11, wherein the concentration of sodium fluoride (NaF) is from 11 g to 15 g per litre of bath and wherein the bath further comprises sulphuric acid ($H_2SO_4$) at a concentration of 75+/−5 mL per litre of bath, the remaining being completed with water ($H_2O$).

* * * * *